US009480324B2

(12) United States Patent
Angelozzi et al.

(10) Patent No.: US 9,480,324 B2
(45) Date of Patent: Nov. 1, 2016

(54) APPARATUS HAVING RIGID THERMALLY-INSULATED CONTAINER, TABLE ASSEMBLY AND COLLAPSIBLE THERMALLY-INSULATED CONTAINER

(71) Applicants: Michael Angelozzi, Blackfalds (CA); Richard Newcomen, Kamloops (CA)

(72) Inventors: Michael Angelozzi, Blackfalds (CA); Richard Newcomen, Kamloops (CA)

( * ) Notice: Subject to any disclaimer, the term of this patent is extended or adjusted under 35 U.S.C. 154(b) by 0 days.

(21) Appl. No.: 14/474,487

(22) Filed: Sep. 2, 2014

(65) Prior Publication Data

US 2016/0060016 A1 Mar. 3, 2016

(51) Int. Cl.
*A45F 3/46* (2006.01)

(52) U.S. Cl.
CPC ..... *A45F 3/46* (2013.01)

(58) Field of Classification Search
CPC ..... A45C 11/20; B65D 25/20; B65D 43/16; B65D 81/3813; B65D 81/3816; B65D 81/3818; B65D 81/382; B65D 81/3823; F25D 3/08; F25D 2331/804; A45F 3/46
USPC ..... 206/541, 545; 220/592.03; 62/457.1, 62/457.7, 457.9; 312/240, 241, 258, 281, 312/282
See application file for complete search history.

(56) References Cited

U.S. PATENT DOCUMENTS 3,880,485 A * 4/1975 Schmelzer ..... A47B 3/10 312/281
4,515,421 A 5/1985 Steffes
5,306,029 A * 4/1994 Kaiser, II ..... A47B 31/02 108/80
5,480,170 A * 1/1996 Kaiser, II ..... A47B 31/02 108/80
5,505,307 A 4/1996 Shink
5,709,105 A * 1/1998 Palermo ..... F25D 3/08 62/457.4
5,730,282 A 3/1998 Bureau
6,176,499 B1 * 1/2001 Conrado ..... A45C 11/20 280/47.26
6,328,179 B1 * 12/2001 Conrado ..... A45C 11/20 206/541
7,128,369 B2 10/2006 Boggs et al.
7,284,393 B1 10/2007 Macmillan
8,327,659 B2 12/2012 Winkler et al.
8,516,848 B2 8/2013 White et al.
2005/0198992 A1 9/2005 Mogil et al.
2008/0245095 A1 10/2008 Schlipman et al.
2009/0217699 A1 * 9/2009 Ball ..... A45C 11/20 62/457.7
2011/0056233 A1 3/2011 Flaker et al.
2011/0248037 A1 * 10/2011 Fung ..... B65D 81/3869 220/592.2
2013/0277259 A1 10/2013 Thomas et al.
2014/0054299 A1 2/2014 Kamin et al.

FOREIGN PATENT DOCUMENTS

CA 2229259 8/1998
CA 2540900 3/2007
CA 2782668 12/2013
TW GB 2379210 A * 3/2003 ..... A45F 3/46

OTHER PUBLICATIONS

Daly, International Search Report and Written Opinion of the ISA, Dec. 3, 2015.

* cited by examiner

*Primary Examiner* — Bryon Gehman
(74) *Attorney, Agent, or Firm* — Giuseppe Mariconda

(57) ABSTRACT

An apparatus includes: a rigid thermally-insulated container; a table assembly configured to be selectively attachable to the rigid thermally-insulated container; and a collapsible thermally-insulated container configured to be selectively attachable to the table assembly.

20 Claims, 15 Drawing Sheets

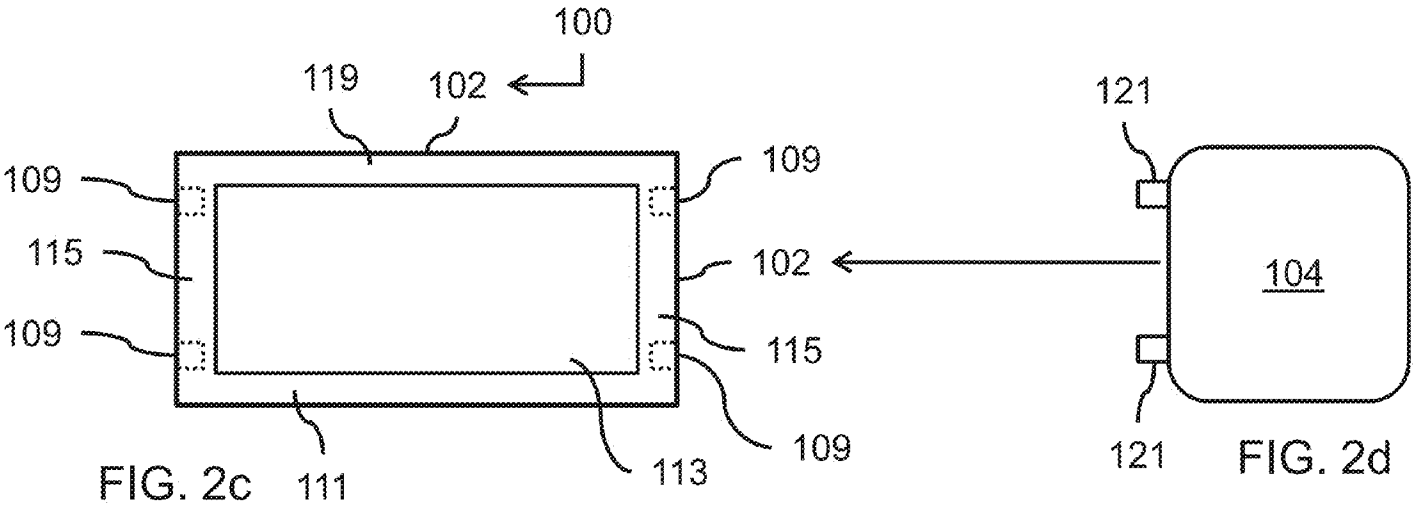
FIG. 2c
FIG. 2d
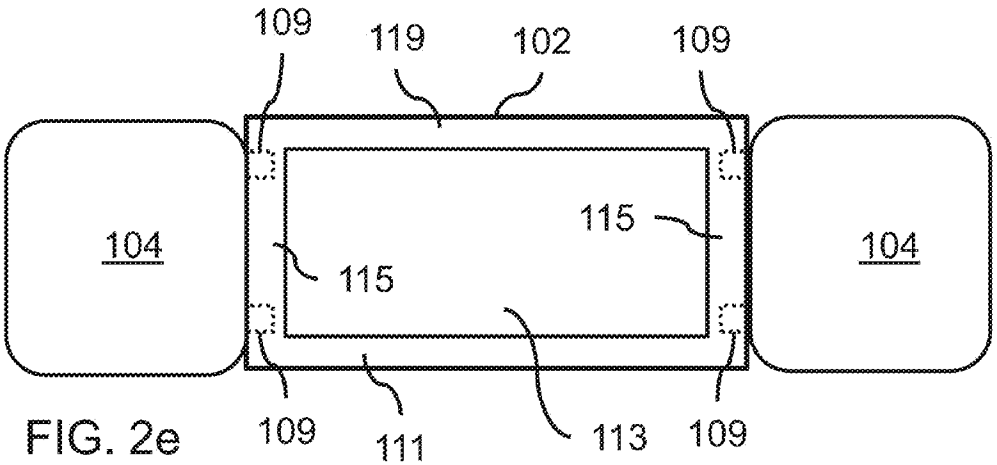
FIG. 2e

APPARATUS HAVING RIGID THERMALLY-INSULATED CONTAINER, TABLE ASSEMBLY AND COLLAPSIBLE THERMALLY-INSULATED CONTAINER

TECHNICAL FIELD

Some aspects generally relate to (and are not limited to) an apparatus including a rigid thermally-insulated container, a table assembly, and a collapsible thermally-insulated container.

BACKGROUND

A cooler, a portable ice chest, an ice box, or a cool box is a thermally-insulated box configured to keep food or beverages cool. For instance, ice cubes are placed in the cooler to keep the contents cool. Ice packs are sometimes used as they contain a gel material sealed inside that may be cooled prior to placement in the cooler.

SUMMARY

In view of the foregoing, it will be appreciated that there exists a need to mitigate (at least in part) problems associated with existing coolers. After much study of the known systems and methods along with experimentation, an understanding of the problem and its solution has been identified and is articulated below.

In order to mitigate, at least in part, the problem(s) identified with existing systems and/or methods for coolers, there is provided (in accordance with an aspect) an apparatus including a rigid thermally-insulated container; a table assembly configured to be selectively attachable to the rigid thermally-insulated container; and a collapsible thermally-insulated container configured to be selectively attachable to the table assembly.

In order to mitigate, at least in part, the problem(s) identified above, in accordance with an aspect, there is provided a method of operating an apparatus including a rigid thermally-insulated container, a table assembly, and a collapsible thermally-insulated container, in which the method includes selectively attaching the table assembly to the rigid thermally-insulated container, and selectively attaching the collapsible thermally-insulated container to the table assembly.

In order to mitigate, at least in part, the problem(s) identified above, in accordance with an aspect, there is provided other aspects as identified in the claims.

Other aspects and features of the non-limiting embodiments may now become apparent to those skilled in the art upon review of the following detailed description of the non-limiting embodiments with the accompanying drawings.

BRIEF DESCRIPTION OF THE DRAWINGS

The non-limiting embodiments may be more fully appreciated by reference to the following detailed description of the non-limiting embodiments when taken in conjunction with the accompanying drawings, in which:

FIGS. 2*a* to 2*l* (SHEETS 2 to 6 of 15 SHEETS) depict views of embodiments of an apparatus including a rigid thermally-insulated container and a table assembly;

Figure 1A:
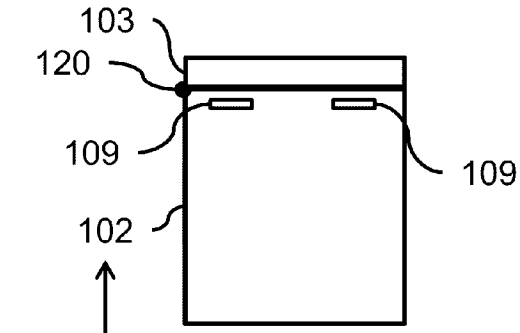
FIGS. 1*a* to 1*d* (SHEET 1 of 15 SHEETS) depict views of embodiments of an apparatus including a rigid thermally-insulated container.

The drawings are not necessarily to scale and may be illustrated by phantom lines, diagrammatic representations and fragmentary views. In certain instances, details not necessary for an understanding of the embodiments (and/or details that render other details difficult to perceive) may have been omitted.

Corresponding reference characters indicate corresponding components throughout the several figures of the Drawings. Elements in the several figures are illustrated for simplicity and clarity and have not necessarily been drawn to scale. For example, the dimensions of some of the elements in the figures may be emphasized relative to other elements for facilitating an understanding of the various presently disclosed embodiments. In addition, common, but well-understood, elements that are useful or necessary in commercially feasible embodiments are often not depicted in order to facilitate a less obstructed view of the various embodiments of the present disclosure.

LISTING OF REFERENCE NUMERALS USED IN THE DRAWINGS

100 apparatus
101 internal lid cavity
102 rigid thermally-insulated container
103 container lid
104 table assembly
105 entrance
106 collapsible thermally-insulated container
107 drain port
108 lid assembly
109 table interface
110 table-support assembly
111 container front wall
113 container interior
115 container side wall
117 container bottom wall
119 container rear wall
120 pivot
121 container interface
122 lid interface
123 vertically-aligned groove
125 horizontally-aligned groove
127 recess zone
129 interior chamber
130 touch fastener
200 flashlight
202 corkscrew
204 flat style bottle opener
206 cooler pack
208 ice
900 ground
910 user

DETAILED DESCRIPTION OF THE NON-LIMITING EMBODIMENT(S)

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of the description herein, the terms "upper," "lower," "left," "rear," "right," "front," "vertical," "horizontal," and derivatives thereof shall relate to the examples as oriented in the drawings. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments (examples), aspects and/or concepts defined in the appended claims. Hence, specific dimensions and other physical characteristics relating to the embodiments disclosed herein are not to be considered as limiting, unless the claims expressly state otherwise. It is understood that "at least one" is equivalent to "a". The aspects (examples, alterations, modifications, options, variations, embodiments and any equivalent thereof) are described with reference to the drawings. It should be understood that the invention is limited to the subject matter provided by the claims, and that the invention is not limited to the particular aspects depicted and described.

Figure 1B:
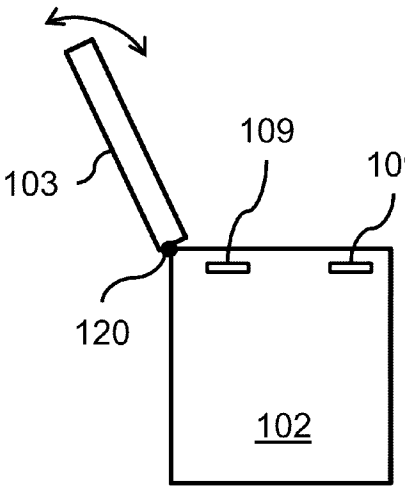
Figure 1C:
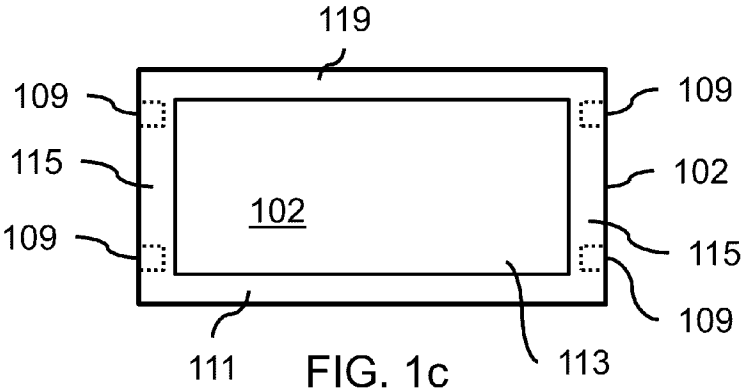
Figure 1D:
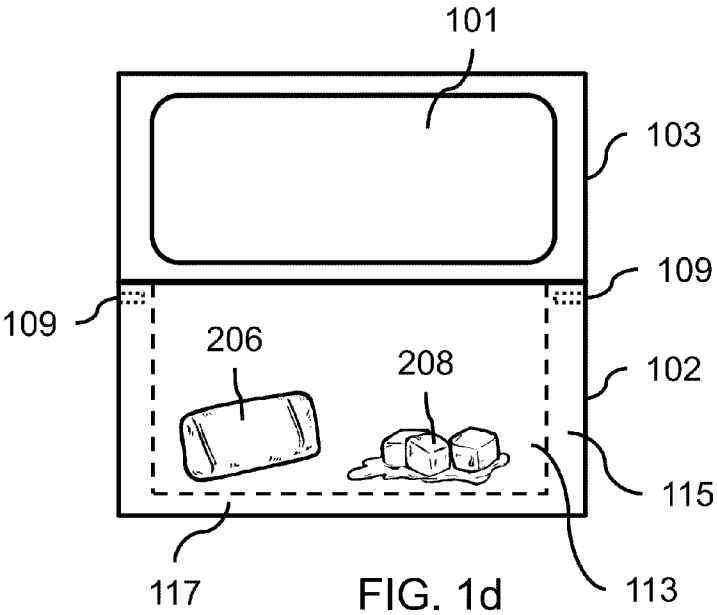

FIGS. 1*a* to 1*d* depict views of embodiments of an apparatus 100 including a rigid thermally-insulated container 102. FIG. 1*a* and FIG. 1*b* depict side views. FIG. 1*c* depicts a top view. FIG. 1*d* depicts a front view.

As depicted, the rigid thermally-insulated container 102 includes a container lid 103 defining an internal lid cavity 101, and a pivot 120 operatively connected to the rigid thermally-insulated container 102 and to the container lid 103. The pivot 120 is configured to facilitate pivotal movement of the container lid 103 relative to the rigid thermally-insulated container 102 between a closed condition (depicted in FIG. 1*a*) and an open position (depicted in FIG. 1*b*). The container includes rigid or non-collapsible instances of side walls, a front wall, a back wall and a bottom wall and associated structural portions. In addition, the rigid thermally-insulated container 102 also includes a container front wall 111, instances of a container side wall 115, a container rear wall 119 and a container bottom wall 117 (all rigid walls). The container front wall 111, the container side wall 115 and the container rear wall 119 extend vertically from the container bottom wall 117. The container front wall 111, the container side walls 115, the container rear wall 119 and the container bottom wall 117 are positioned (and attached) in such a way as to define a container interior 113. The container lid 103 is configured to be pivotally movable relative to the container interior 113 (to facilitate user access to the container interior 113). It will be appreciated that in accordance with another option, the container lid 103 may remain detached from the rigid thermally-insulated container 102 and is simply positioned at (and movable away from) the entranceway leading to the interior 113 (in order to open and close the rigid thermally-insulated container 102, if so desired, without having to pivotally connect the container lid 103 to the rigid thermally-insulated container 102). The interior 113 is configured to receive a cooler pack 206 and/or ice 208 and food (user items) to be kept cool. The rigid thermally-insulated container 102 includes a thermal-insulation material placed in the interior of the container side walls 115, the container front wall 111, the container rear wall 119 and the container bottom wall 117 and the container lid 103.

In accordance with the embodiment as depicted, opposite container side walls 115 define or provide a table interface 109. For instance, the table interface 109 includes (provides or defines) a groove or a horizontally-aligned groove defined by a vertically extending wall of the rigid thermally-insulated container 102. In general terms, the table interface 109 is configured to interface with a table assembly 104 (depicted in FIG. 2*a*). For instance, the table interface 109 may be configured to snap-fit with the table assembly 104 (for convenience, if so desired). It will be appreciated that the table interface 109 may include any type of quick connect and disconnect device. It will be appreciated that there are many options contemplated for the placement (location) of the table interface 109 relative to the rigid thermally-insulated container 102. FIGS. 1*a* to 1*d* depict one option for the placement of the table interface 109. FIGS. 2*f* to 2*l* depict another option (the preferred option) for the placement of the table interface 109.

Referring to FIG. 1*a*, the container lid 103 is positioned in a closed state (condition). Referring to FIG. 1*b*, the container lid 103 is positioned in an open state. Referring to FIG. 1*c*, the container lid 103 has been removed for improved viewing of the interior of the rigid thermally-insulated container 102. Referring to FIG. 1*d*, the container lid 103 is positioned in the open state.

The rigid thermally-insulated container 102 is configured to have a rigid structure; specifically, the rigid thermally-insulated container 102 is configured to be non-collapsible. For instance, the rigid thermally-insulated container 102 includes side walls upstanding from a bottom wall and configured to define an interior space therein, and a container lid 103 is configured to selectively open and close the entrance leading to the interior space of the rigid thermally-insulated container 102. The rigid thermally-insulated container 102 includes an insulation material placed in the interior of the side walls and of the bottom wall.

Referring to the embodiment of FIG. 1*e*, there is depicted an option in which the instances of the table interface 109 are positioned on a top edge of the vertically-extending wall of the rigid thermally-insulated container 102 (such as the container side walls 115). The instances of the table interface 109 are spaced apart from each other. The manner in which the table interface 109 of FIG. 1*e* is used is depicted in FIG. 2*f*.

Figure 2A:
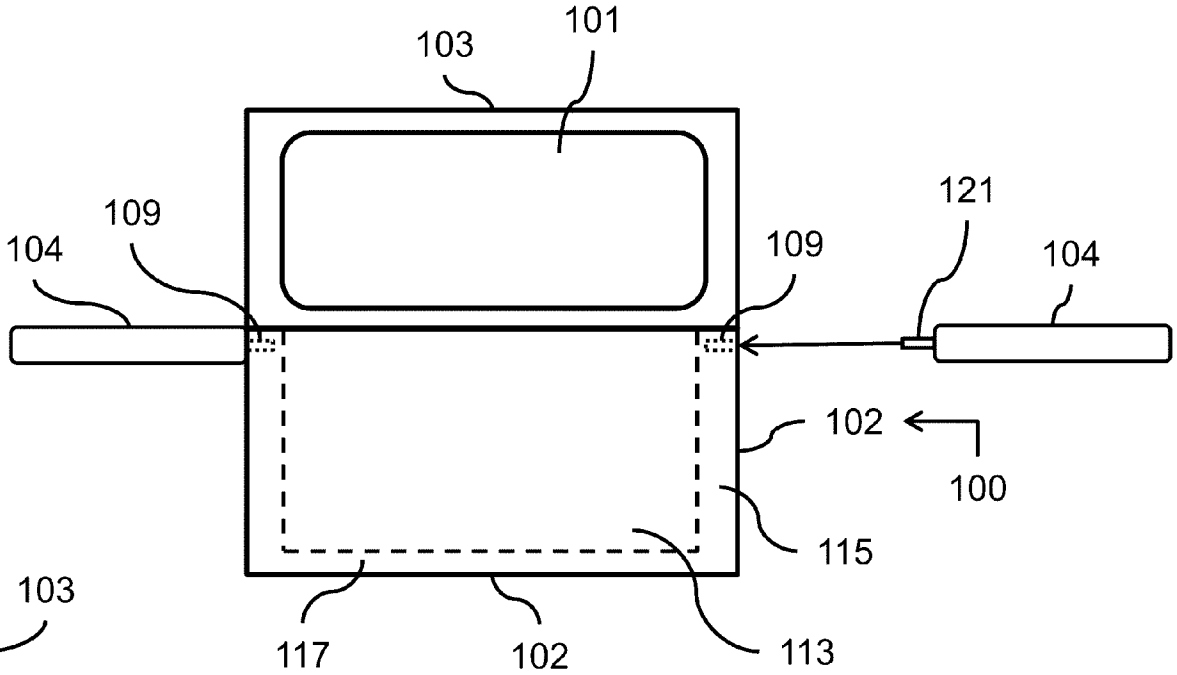
Figure 2B:
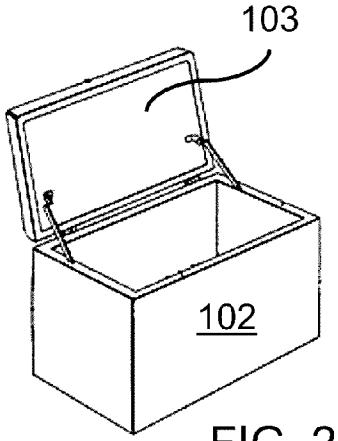
Figure 2G:
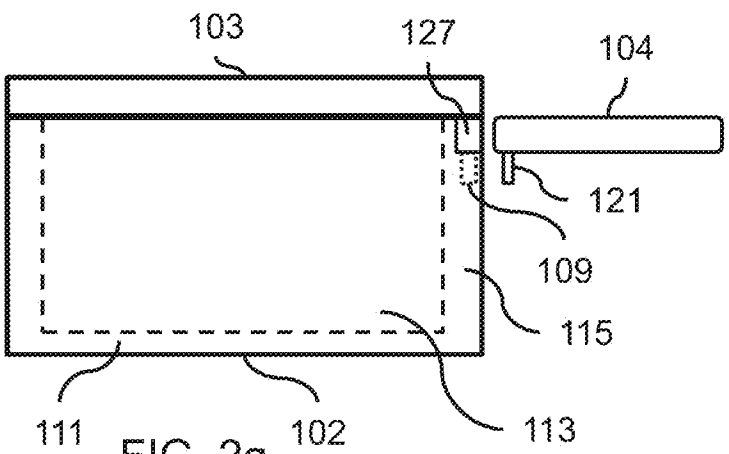
Figure 2F:
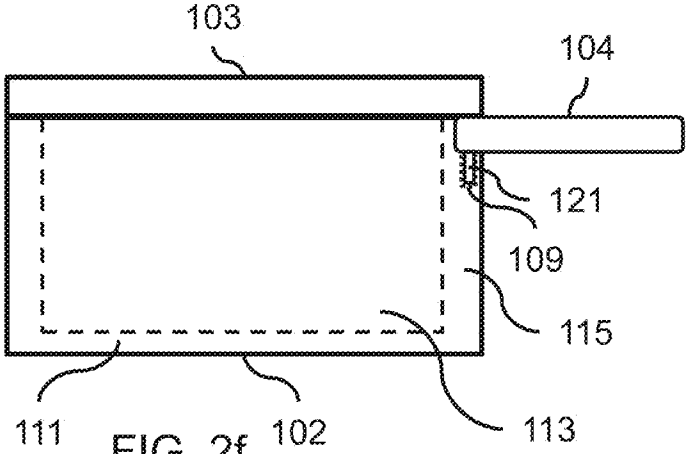
Figure 2H:
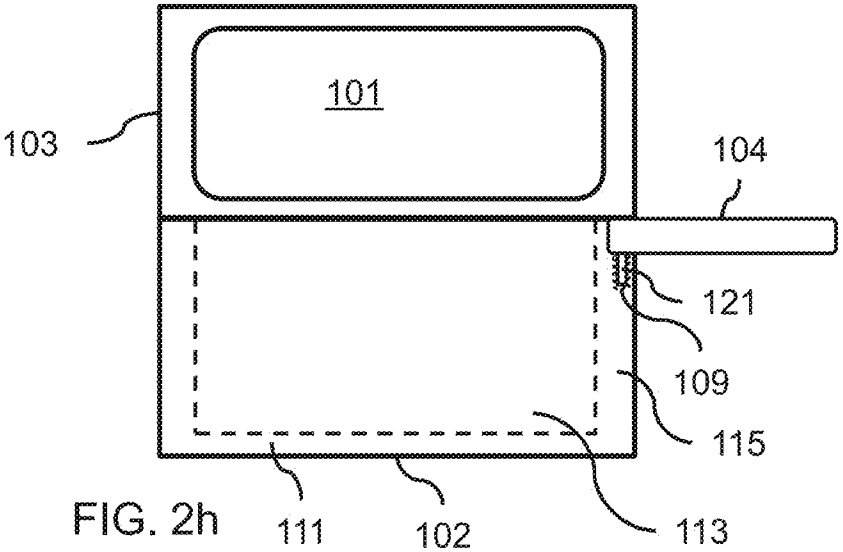
Figure 2I:
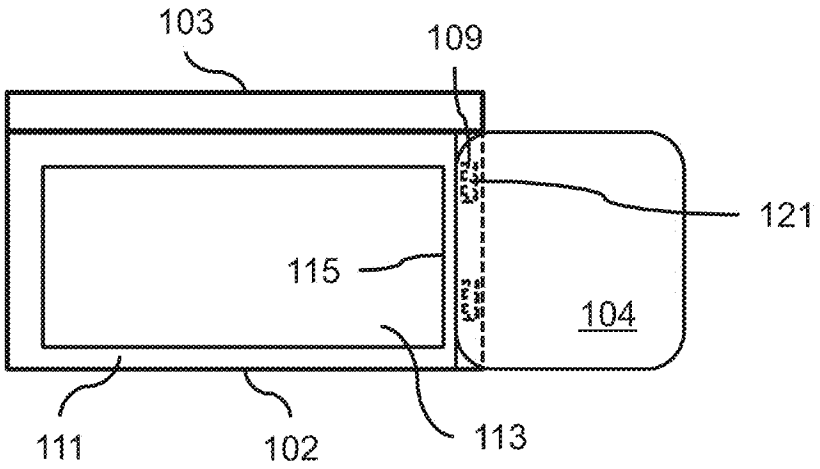
Figure 2J:
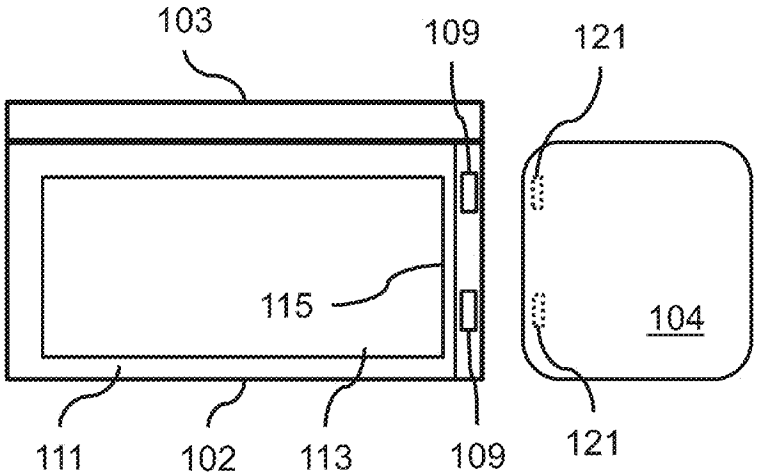
Figures 2K, 2L:
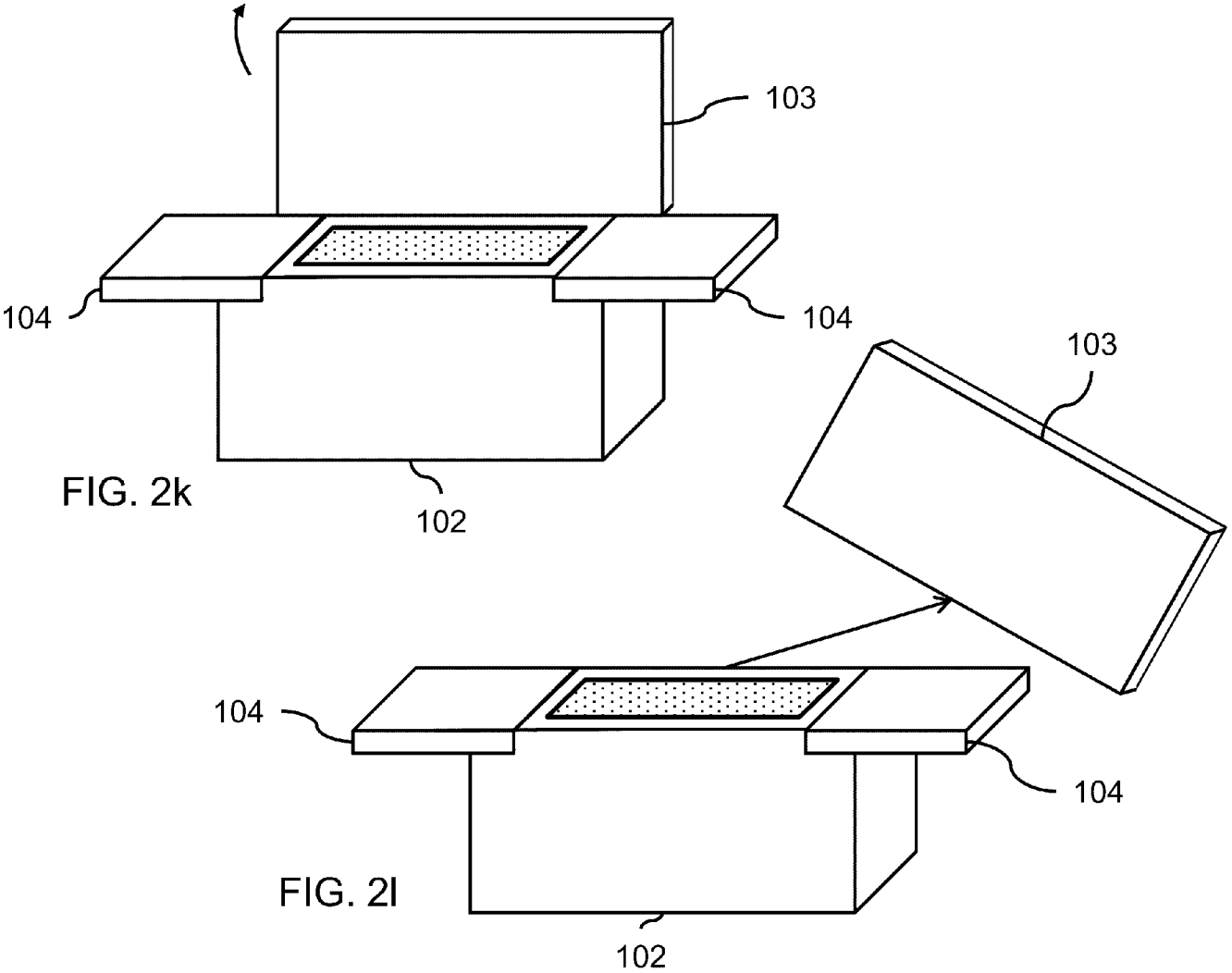

FIGS. 2*a* to 2*l* depict views of embodiments of the apparatus 100 including the rigid thermally-insulated container 102 and the table assembly 104. FIG. 2*a* depicts a front view. FIG. 2*b* depicts a perspective view. FIG. 2*c* depicts a top view. FIGS. 2*d* and 2*e* depict top views. FIGS. 2*f* to 2*h* depict side views. FIGS. 2*i* and 2*j* depict top views. FIGS. 2*k* and 2*l* depict perspective views.

Referring to the embodiment of FIG. 2*a*, the table assembly 104 includes a container interface 121. The container interface 121 extends from the table assembly 104. For instance, the container interface 121 may include a tab, a dowel or a pin. The container interface 121 is configured to interface with the table interface 109 of the rigid thermally-insulated container 102. The table interface 109 and the container interface 121 are configured to securely connect and interface with each other. For instance, it will be appreciated that the table interface 109 may include any combination and permutation of tabs and grooves, and the container interface 121 may include any combination and permutation of tabs and grooves. For instance, the container interface 121 may be snap-fitted to the table interface 109, or the container interface 121 may be friction fitted to the table interface 109, etc.

Generally, the table interface 109 and the container interface 121 are configured to be selectively attachable to and selectively detachable from each other. The user may selectively attach the table interface 109 and the container interface 121 together in order to attach the table assembly 104 to the rigid thermally-insulated container 102. Of course, once the table interface 109 and the container interface 121 are selectively detached from each other, the apparatus 100 may be stored away.

In accordance with another option, the container interface 121 of the table assembly 104 is configured to be slide engageable with the table interface 109 of the rigid thermally-insulated container 102. The container interface 121 of the table assembly 104 may be configured to be lockably engageable to and disengageable from the table interface 109 of the rigid thermally-insulated container 102 (if so desired). The table assembly 104 and the container interface 121 may be molded as a single one-piece unit, if so desired.

Referring to the embodiment of FIGS. 2*a* and 2*b*, the container lid 103 is placed in an open state relative to the rigid thermally-insulated container 102, and the container lid 103 is pivotally connected to the rigid thermally-insulated container 102. It will be appreciated that the container lid 103 may be permanently detached from the rigid thermally-insulated container 102 (if so desired), or that the container lid 103 may be operatively coupled with the rigid thermally-insulated container 102. An additional support is provided for the table assembly 104 as depicted (for instance) in the embodiments depicted in FIGS. 5*a* to 5*j*.

Referring to the embodiments of FIGS. 2*c*, 2*d* and 2*e*, the container interface 121 of the table assembly 104 is configured to be slide engageable with the table interface 109 of the rigid thermally-insulated container 102. It will be appreciated that the container interface 121 of the table assembly 104 may be configured to be slide engageable with the table interface 109 that is provided by a selected wall of the rigid thermally-insulated container 102. An additional support is provided for the table assembly 104 as depicted (for instance) in the embodiments depicted in FIGS. 5*a* to 5*j*.

In accordance with the embodiment as depicted in FIG. 2*e*, opposite container side walls 115 of the rigid thermally-insulated container 102 each provide an instance of the table interface 109 that is configured to interact with a respective instance of the container interface 121 of an instance of the table assembly 104 that is positioned on the opposite sides of the rigid thermally-insulated container 102. An additional support is provided for the table assembly 104 as depicted (for instance) in the embodiments depicted in FIGS. 5*a* to 5*j*.

In accordance with an option, at least one vertically extending wall of the rigid thermally-insulated container 102 provides or defines at least one instance of the table interface 109 configured to interact with at least one instance of the container interface 121 of at least one instance of the table assembly 104 (if so desired).

In accordance with another option, each vertically extending wall of the rigid thermally-insulated container 102 provides or defines an instance of the table interface 109 each of which is configured to interact with a respective instance of the container interface 121 of a respective instance of the table assembly 104. That is, each wall of the rigid thermally-insulated container 102 may interact with a respective instance of the table assembly 104.

In accordance with another option, each vertically extending wall of the rigid thermally-insulated container 102 provides or defines an instance of the table interface 109 each of which is configured to interact with a respective instance of the container interface 121 of a respective instance of the table assembly 104. That is, each wall of the rigid thermally-insulated container 102 may interact with a respective instance of the table assembly 104.

It will be appreciated that other options are possible for the table interface 109 and the container interface 121 that are within the scope of persons skilled in the art to understand.

For instance, the table assembly 104 is configured to be selectively attachable to the rigid thermally-insulated container 102; it is appreciated that the table assembly 104 is configured to not interfere with the normal operation of the container lid 103 (that is, the normal operation of opening and closing the container lid 103). In accordance with the embodiment depicted FIG. 2*a*, instances of the table assembly 104 are each configured to be selectively attachable to opposite side walls of the rigid thermally-insulated container 102. It will be appreciated that, at a minimum, a single instance of the table assembly 104 is configured to be selectively attachable to a selected side wall of the rigid thermally-insulated container 102. As well, in accordance with another embodiment (not depicted but easy to understand in view of the embodiment of FIG. 2*a*), instances of the table assembly 104 are each configured to be selectively attachable to a respective side wall of the rigid thermally-insulated container 102. In accordance with an option, the table assembly 104 is further configured to be selectively detachable from the rigid thermally-insulated container 102. Specifically, the table assembly 104 is fixedly attached to the rigid thermally-insulated container 102 once positioned at a deployment position to do just so (as depicted in FIG. 2*a*).

Referring to the embodiments depicted in FIGS. 2*f* to 2*l*, it will be appreciated that the container lid 103 is depicted (in FIGS. 2*f* and 2*g*) in the closed condition (that is, the container lid 103 is closed against the rigid thermally-insulated container 102 to shut the interior 113 from user access), and the container lid 103 is depicted (in FIGS. 2*h*, 2*i*, 2*j*, 2*k* and 2*l*) in the open condition (that is, user access is permitted to the interior 113 of the rigid thermally-insulated container 102). It will be appreciated that for the embodiments of FIGS. 2*f* to 2*k*, the container lid 103 is operatively pivotally mounted to the rigid thermally-insulated container 102. It will be appreciated that for the embodiment of FIG. 2*l*, the container lid 103 is operatively detachable from the rigid thermally-insulated container 102. The container interface 121 extends from a bottom surface of the table assembly 104 once the table assembly 104 is positioned in the horizontal condition. An outer perimeter of the container side walls 115 defines a recess zone 127 that faces outwardly from the container side wall 115 (at least one instance of the container side wall 115) at a top section of the container side wall 115. The table interface 109 is positioned on a top portion of the container side wall 115 below the recess zone 127, and the table interface 109 is in communication with the recess zone 127. It is understood that the recess zone 127 extends (at least in part) from the front wall to the back wall of the rigid thermally-insulated container 102. The recess zone 127 is configured (shaped) to accommodate (at least in part) or to receive a side portion (edge portion) of the table assembly 104, while the container interface 121 of the table assembly 104 is received in the table interface 109 defined or provided by a top section of the container side walls 115 of the rigid thermally-insulated container 102. The table interface 109 and the container interface 121 are aligned along a coaxial direction along the vertical direction (once they are operatively installed relative to each other). Of course, the table interface 109 and the container interface 121 may be configured to be snap-fitted together (if so desired). An additional support is provided for the table assembly 104 as depicted (for instance) in the embodiments depicted in FIGS. 5*a* to 5*j*.

Figure 3A:
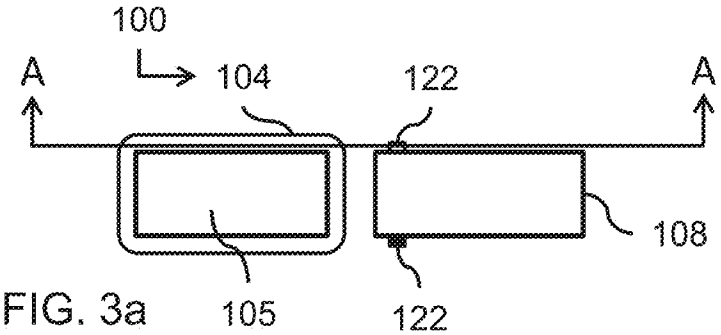
FIGS. 3*a* to 3*g* (SHEET 7 of 15 SHEETS) depict views of embodiments of a table assembly and a lid assembly for use with the apparatus of FIGS. 2*a* to 2*l;*
Figure 3B:
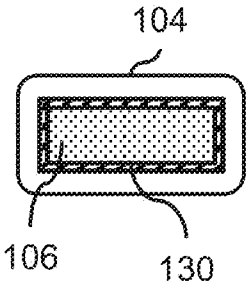
Figure 3C:
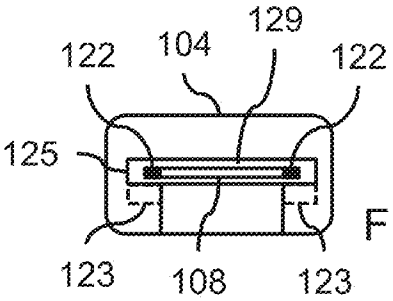

FIGS. 3*a* to 3*g* depict views of an embodiment of a table assembly 104 and a lid assembly 108 for use with the apparatus of FIGS. 2*a* to 2*l*. FIGS. 3*a* and 3*b* depict top views. FIG. 3*c* depicts an end view. FIGS. 3*d* to 3*g* depict side views along a cross-section line A-A of FIG. 3*a*. It will be appreciated that the table assembly 104 may be called a lid support assembly, which is configured to spatially support the lid assembly 108 relative to the rigid thermally-insulated container 102.

Referring to the embodiment of FIG. 3*a*, the table assembly 104 is spaced apart from the lid assembly 108. For instance, the lid assembly 108 has a top surface configured to be flush with a top surface of the table assembly 104. The lid assembly 108 includes a lid interface 122. The lid interface 122 may include, for instance, a pin or a dowel. As depicted in FIG. 3*a*, it will be appreciated that the lid assembly 108 is not positioned in such a way as to be slidably engaged with the table assembly 104. The lid interface 122 is positioned on opposite lateral sides of the lid assembly 108 (at a distal end of the lid assembly 108). The table assembly 104 is configured to slidably and engageably receive the lid interface 122 of the lid assembly 108 in such a way as to permit sliding movement of the lid assembly 108 along a length of the table assembly 104. In accordance with the embodiment of FIG. 3*a*, the table assembly 104 defines an entrance 105 (also called a pass-through hole) for the case where the table assembly 104 does not interact with the lid assembly 108 (that is, when the lid assembly 108 is spaced apart from the table assembly 104). The table assembly 104 is configured to slidably and engageably receive (at least in part) the lid assembly 108 (as depicted in FIG. 3*b* once the lid interface 122 engages with the table assembly 104). Once the table assembly 104 slidably engageably receives the lid assembly 108, the entrance 105 becomes covered (at least in part) by the lid assembly 108.

Referring to the embodiment of FIG. 3*b*, the table assembly 104 defines an entrance 105 configured to interface with a collapsible thermally-insulated container 106. The collapsible thermally-insulated container 106 is configured to be fixedly mounted to the inner walls of the table assembly 104 that define or provide the entrance 105. For instance, a touch fastener 130 is positioned along (at least in part) an inner perimeter of the entrance 105. The collapsible thermally-insulated container 106 also includes a touch fastener 130 positioned on (at least in part) an exterior periphery of the collapsible thermally-insulated container 106, and in this manner the collapsible thermally-insulated container 106 is selectively connectable to and selectively disconnectable from the table assembly 104. For instance, the touch fastener 130 may include the VELCRO (TRADEMARK) fastener and any equivalent thereof. The touch fastener 130 is configured to support the weight of the collapsible thermally-insulated container 106 and to support the operative weight to be received by the collapsible thermally-insulated container 106.

Referring to the embodiment of FIG. 3*c*, the lid assembly 108 is received (at least in part) in an interior chamber 129 defined by the table assembly 104. The table assembly 104 defines a horizontally-aligned groove 125 positioned on opposite lateral sections of the table assembly 104 and on the opposite sides of the interior chamber 129 of the table assembly 104. The horizontally-aligned groove 125 is configured to slidably engageably receive the lid interface 122 of the lid assembly 108. The lid interface 122 slidably engages along a length of the horizontally-aligned groove 125 of the table assembly 104. The horizontally-aligned groove 125 extends across opposite lateral sides of the table assembly 104.

Figure 3D:
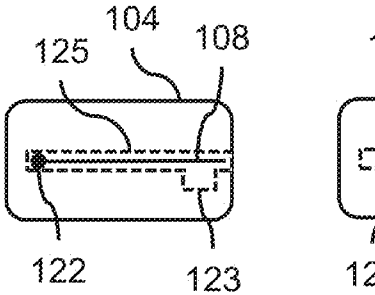

Referring to the embodiment of FIG. 3*d*, the lid interface 122 is depicted at one end of the horizontally-aligned groove 125, in which case the entrance 105 of FIG. 3*a* is covered by the lid assembly 108, and the lid assembly 108 remains horizontally oriented. The lid assembly 108 is operatively received into the interior chamber 129 defined by the table assembly 104 in such a way that the entrance 105 is fully (operatively) covered.

Figure 3E:
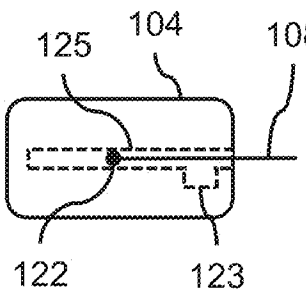

Referring to the embodiment of FIG. 3*e*, the lid interface 122 is positioned part way between the opposite ends of the table assembly 104, in which case the entrance 105 of FIG. 3*a* is partly covered by the lid assembly 108, and the lid assembly 108 remains horizontally oriented within the interior chamber 129 of the table assembly 104.

Figure 3F:
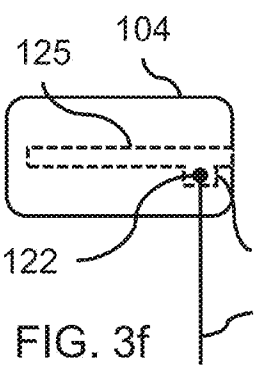

Referring to the embodiment of FIG. 3*f*, the table assembly 104 defines a vertically-aligned groove 123 that extends downwardly from the horizontally-aligned groove 125 at a distal end of the table assembly 104. The horizontally-aligned groove 125 is horizontally aligned once the table assembly 104 is horizontally aligned. The lid interface 122 is received in the vertically-aligned groove 123. For FIG. 3*e*, the lid assembly 108 is positioned in a vertical orientation once the lid interface 122 is received in the vertically-aligned groove 123. The arrangement of FIG. 3*e* permits the lid assembly 108 to remain in an open state and in a relatively safer position, thereby exposing the entrance 105 (depicted in FIG. 3*b*) so that the user may have access to the collapsible thermally-insulated container 106 via the entrance 105. It is understood that the lid assembly 108 does not receive weight in the orientation or position as depicted in FIG. 3F.

Figure 3G:
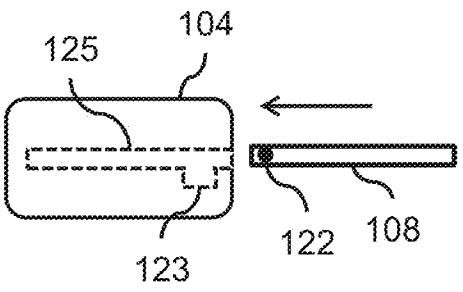

Referring to the embodiment of FIG. 3*g*, the table assembly 104 is spaced apart from the lid assembly 108; the lid assembly 108 has been completely removed from the table assembly 104 so that the lid assembly 108 may be cleaned or may be maintained (as may be required by the user).

Figure 4A:
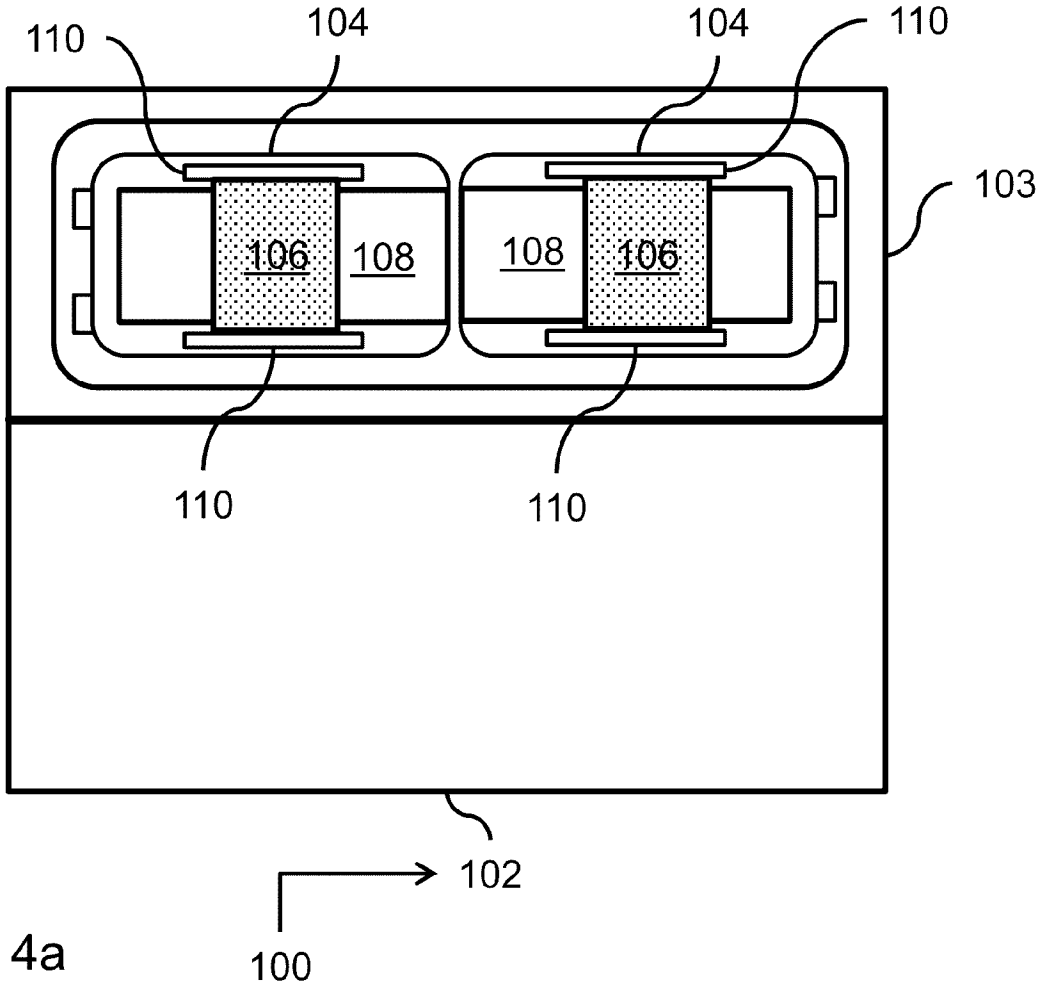
FIGS. 4*a* to 4*b* (SHEETS 8 and 9 of 15 SHEETS) depict views of embodiments of an apparatus including a rigid thermally-insulated container, a table assembly, a lid assembly and a table-support assembly.
Figure 4B:
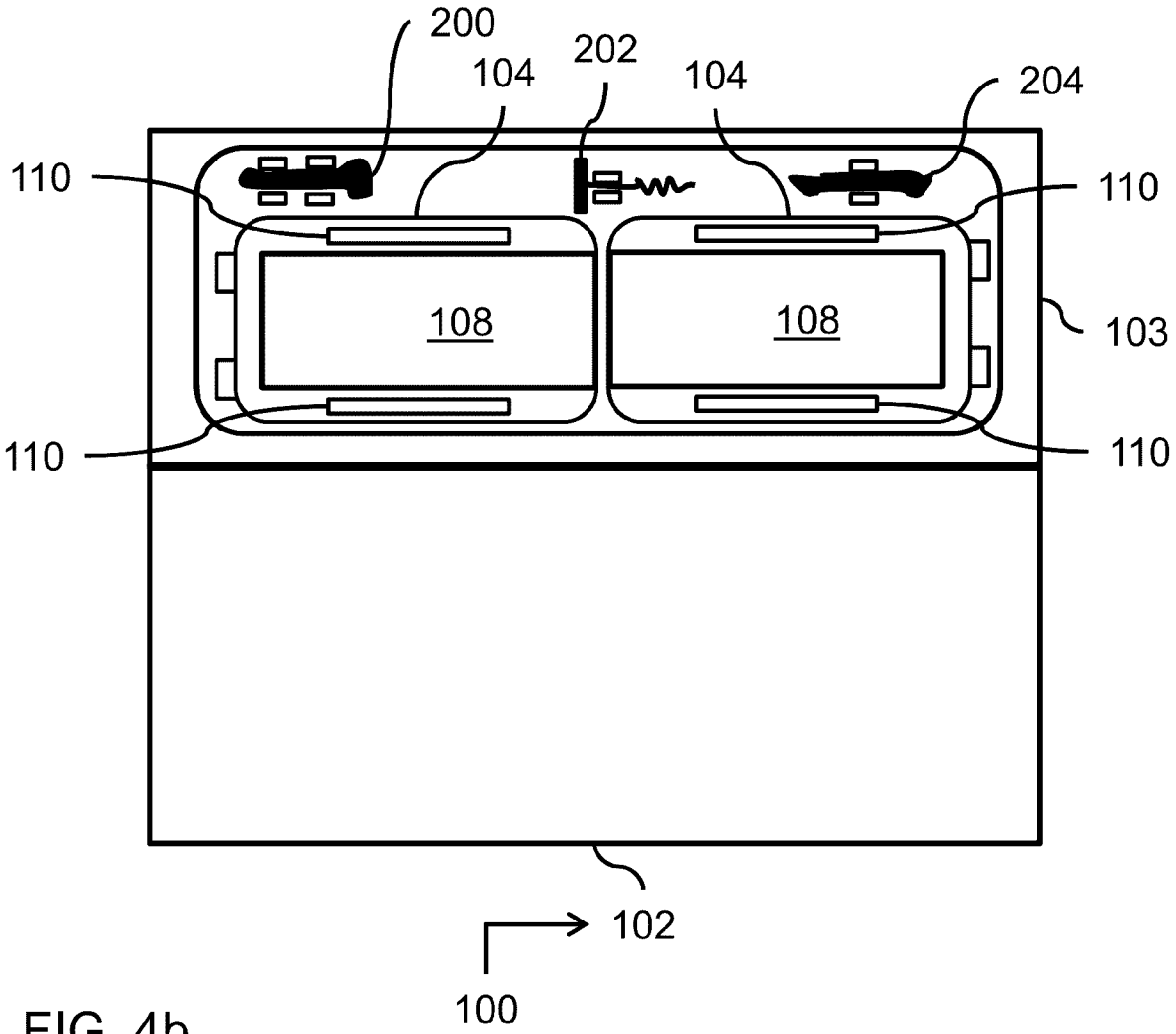

FIGS. 4*a* to 4*b* depict a view of embodiments of the apparatus 100 including the rigid thermally-insulated container 102, the table assembly 104, the lid assembly 108 and the table-support assembly 110. FIGS. 4*a* and 4*b* depict front views.

It will be appreciated that in a storage position (as depicted in FIG. 4*a*), the collapsible thermally-insulated container 106 is fixedly detachable from the table assembly 104 in such a way that the collapsible thermally-insulated container 106 collapses into a collapsed state (folded state). Specifically, the table assembly 104 is fixedly detached from the rigid thermally-insulated container 102 once positioned at a storage position to do just so (as depicted in FIG. 4*a*). Specifically, the table assembly 104 is fixedly detached from the rigid thermally-insulated container 102 once positioned at a storage position to do just so (as depicted in FIG. 4*a*).

In the storage position (as depicted in FIG. 4*a*), the table assembly 104, the collapsible thermally-insulated container 106 and a table-support assembly 110 (depicted in FIG. 5*a*) are securely positioned in a storage position in the container lid 103 of the rigid thermally-insulated container 102; this is done in such way that storage space required for the apparatus 100 is simply (and conveniently) the storage space required for the storage of the rigid thermally-insulated container 102. In this way, the storage space for the apparatus 100 may be reduced, at least in part. It will be appreciated that there are many options for the manner in which to store the table assembly 104, the collapsible thermally-insulated container 106 and the table-support assembly 110 in the container lid 103, as would be understood and appreciated by persons skilled in the art.

For instance, the table assembly 104 is configured to receive the lid assembly 108. The table assembly 104 may also be configured to receive the table-support assembly 110 (for secure storage). The container lid 103 of the rigid thermally-insulated container 102 is configured to securely receive the table assembly 104. The table assembly 104 is configured to securely receive the collapsible thermally-insulated container 106 (in the collapsed state) for secure storage thereof. It will be appreciated that many other options are possible for arrangements for the storage of the components of the apparatus 100 as will be appreciated by persons of skill in the art.

Referring to the embodiments depicted in FIGS. 4*a* and 4*b*, the table assembly 104 may be stored in the inside section of the container lid 103 of the rigid thermally-insulated container 102; specifically, the table assembly 104 may be snap-fitted or clipped into the inside section of the container lid 103. The user may retrieve the table assembly 104 from the storage position by opening the container lid 103 of the rigid thermally-insulated container 102. The table assembly 104 has a smooth surface. For instance, the height of the container lid 103 may be about 0.5 inches to about 2.5 inches. Each instance of the table assembly 104 is configured to be snap-fitted to the interior zone of the container lid 103. Specifically, each instance of the table assembly 104 is configured to be snap-fitted to a corresponding side of the interior zone of the container lid 103 of the rigid thermally-insulated container 102. For instance, the table assembly 104 is configured to extend up to approximately one half of the total longest side-to-side length of the rigid thermally-insulated container 102 (if desired). For instance, the table assembly 104 is configured to be snapped into place using plastic dowels located or placed in the interior zone of the container lid 103 of the rigid thermally-insulated container 102. The table-support assembly 110 is configured to be snapped into place using plastic dowels located or placed in the container lid 103 of the rigid thermally-insulated container 102, or may be snap-fitted to the table assembly 104 (if so desired).

Referring to the embodiment depicted in FIG. 4*a*, the collapsible thermally-insulated container 106 is configured to be detached from the table assembly 104 (depicted in FIG. 3*b*), and to collapse (fold down), and to be stored in the interior zone of the container lid 103 of the rigid thermally-insulated container 102 (if so desired). When ready for storage, the collapsible thermally-insulated container 106 is configured to fold up (become collapsed) into itself in such a way that the collapsible thermally-insulated container 106 (once folded) may be positioned (for instance) in a cut-out located underneath the table assembly 104; in this manner, the collapsible thermally-insulated container 106 may be oriented in a flush fit into the interior zone of the container lid 103 of the rigid thermally-insulated container 102 (if so desired).

Referring to the embodiment of FIG. 4*b*, the container lid 103 is depicted in an open condition; various user attachments are visible and positioned in the interior zone of the container lid 103; the user attachments are snap-fitted to the inner section of the container lid 103. Inside the container lid 103 along the upper side, the container lid 103 provides formed slots configured to receive and hold a cooler pack 206 (depicted in FIG. 1*d*), a flashlight 200, a corkscrew 202, and/or a flat style bottle opener 204, all with their specific (corresponding) molded holding areas.

Figure 5A:
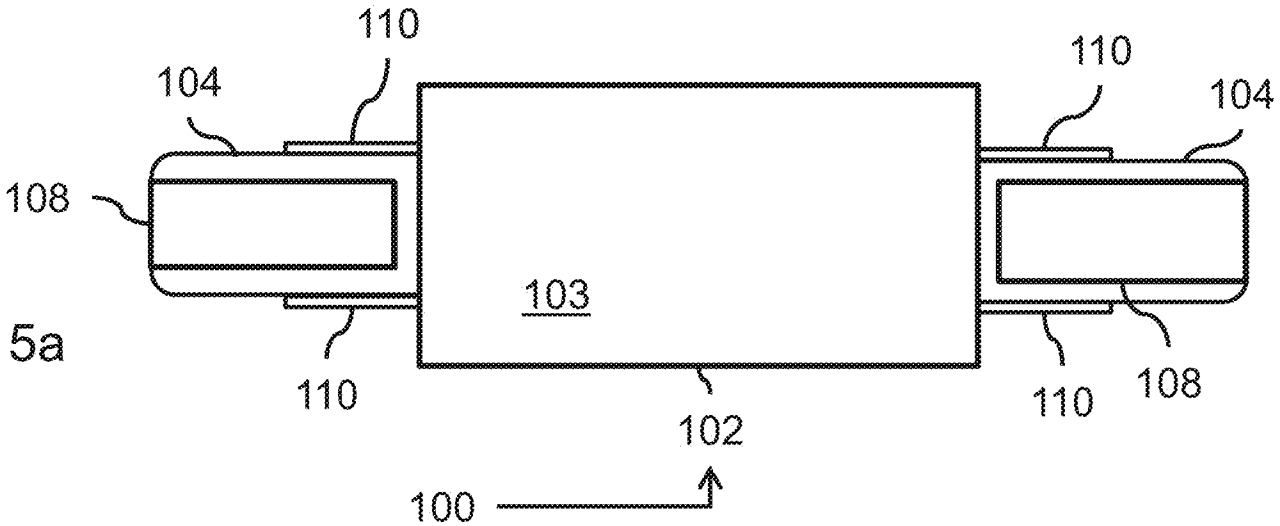
FIGS. 5*a* to 5*j* (SHEETS 10 to 14 of 15 SHEETS) depict views of embodiments of the apparatus of FIG. 4*a*.
Figure 5B:
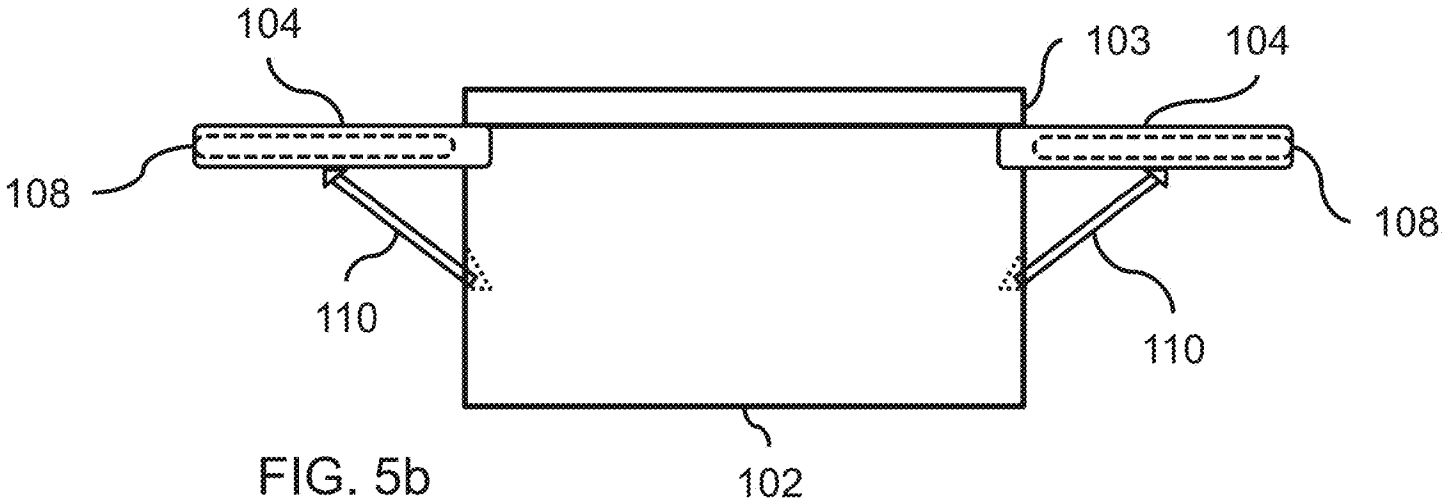
Figure 5C:
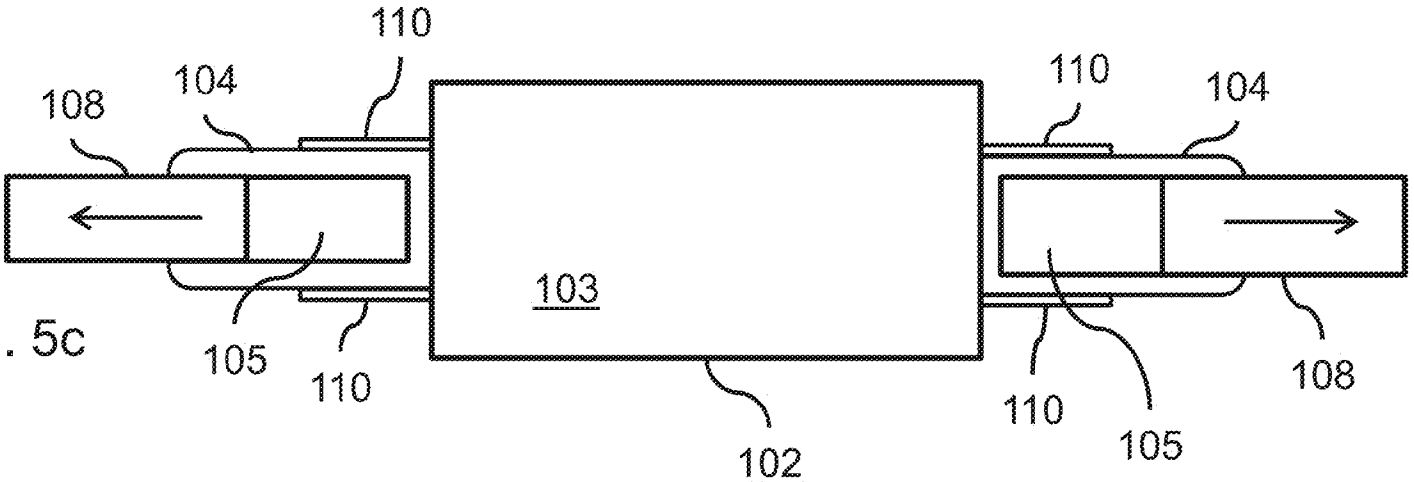
Figure 5D:
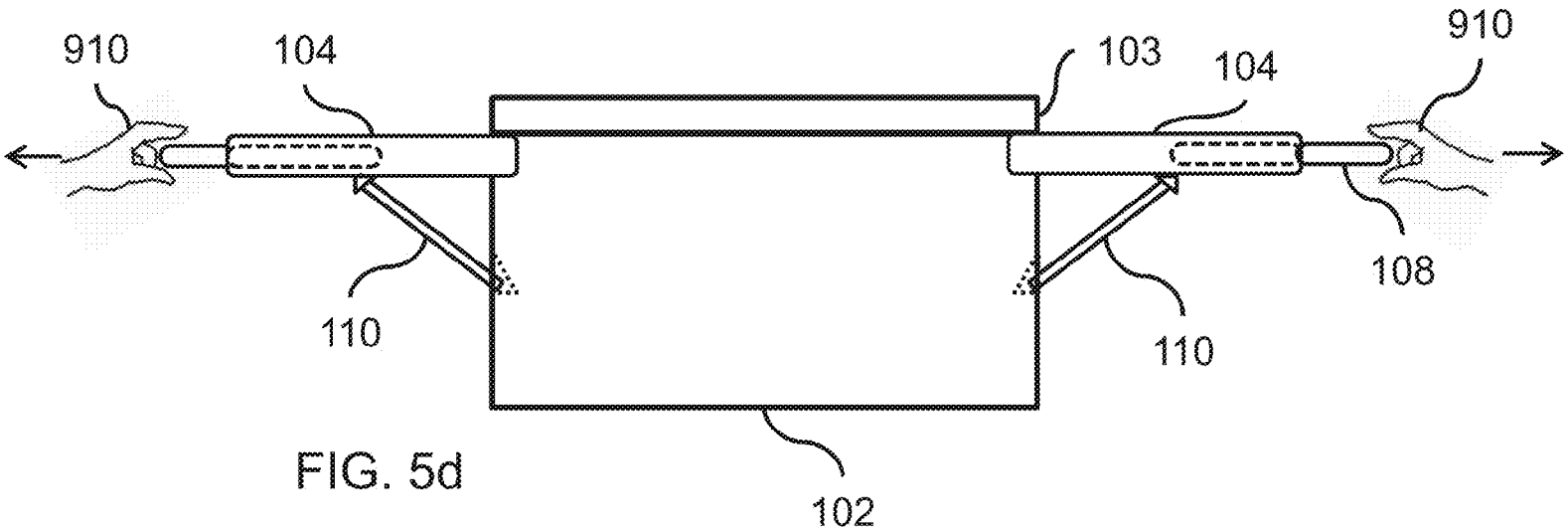
Figure 5E:
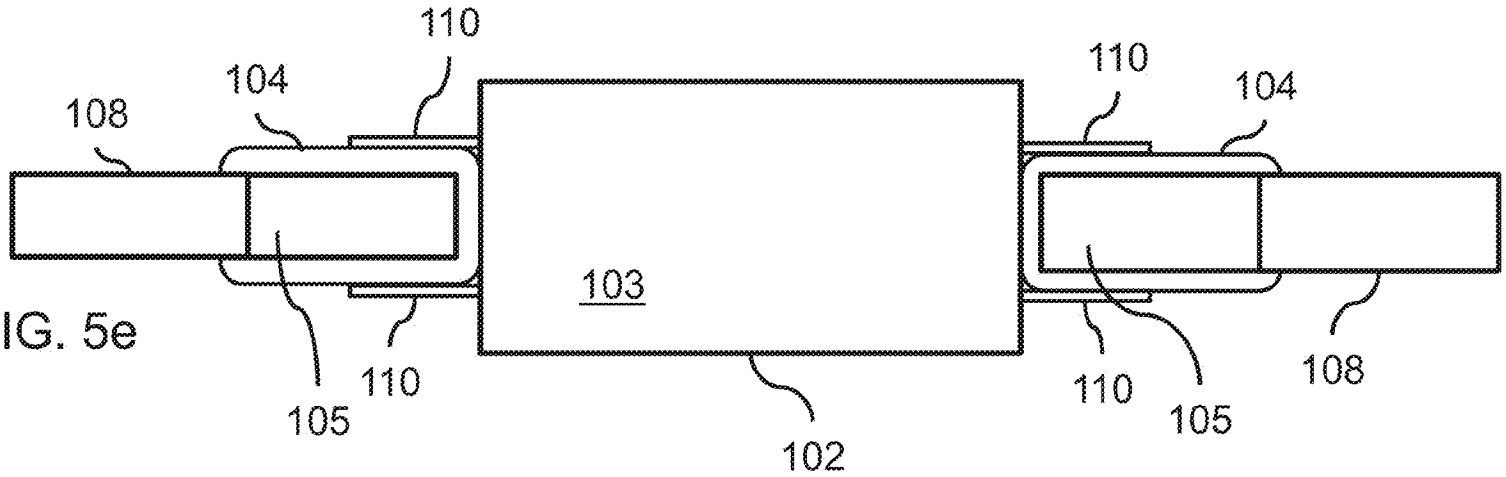
Figure 5F:
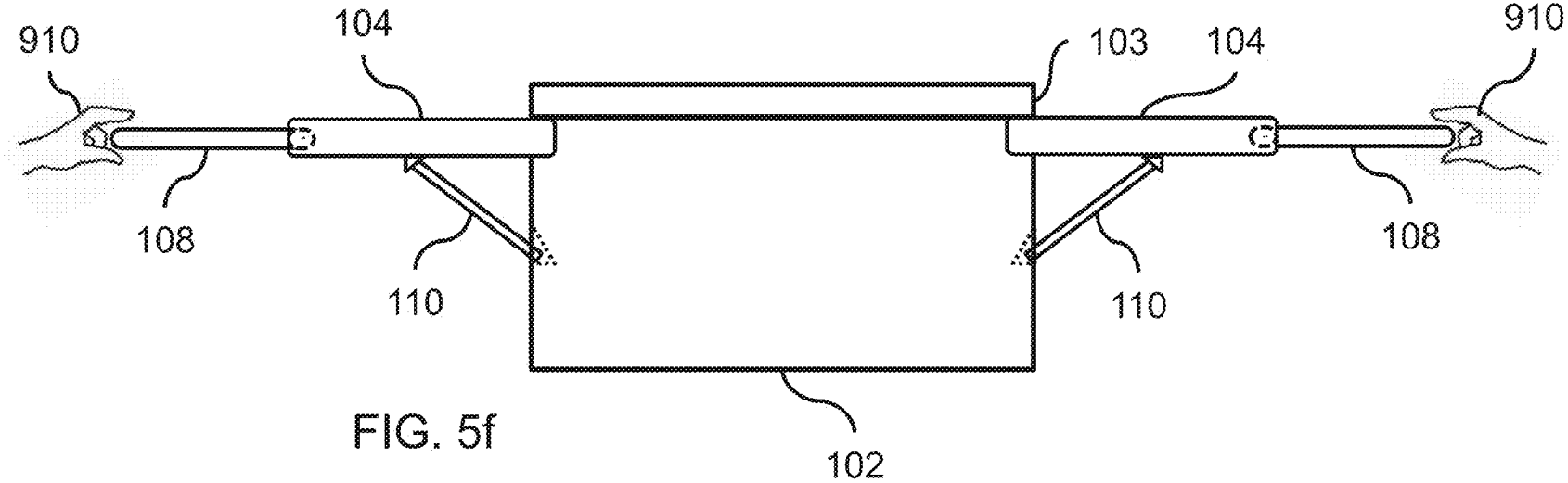
Figure 5G:
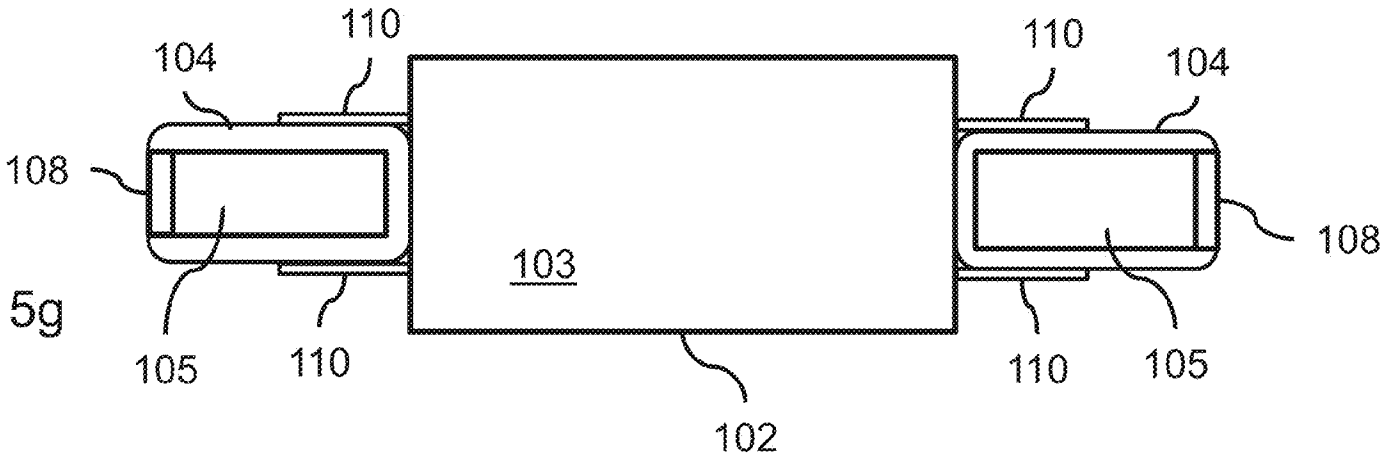
Figure 5H:
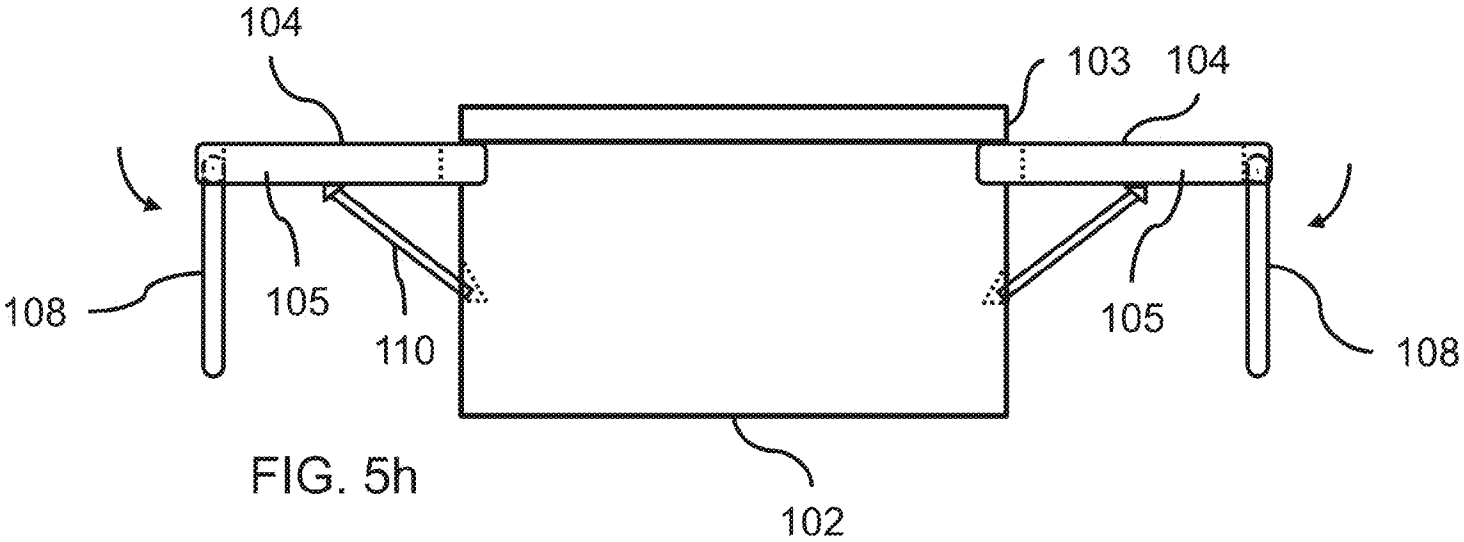
Figure 5J:
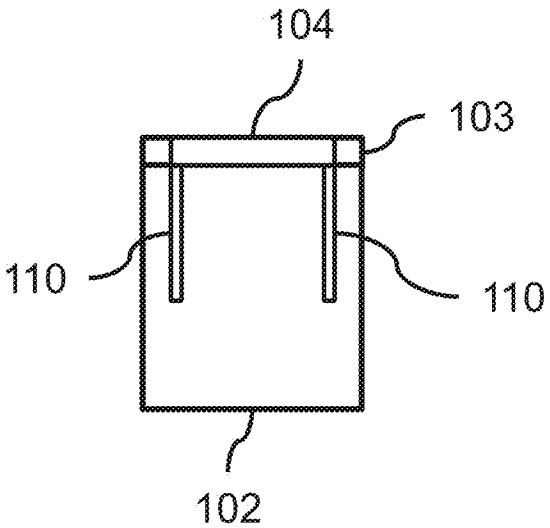
Figure 5I:
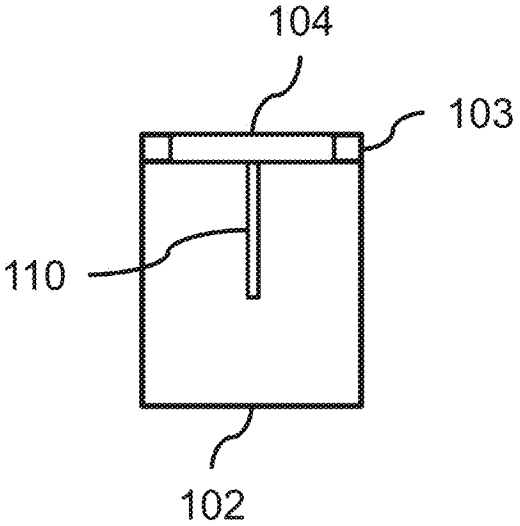

FIGS. 5*a* to 5*j* depict views of embodiments of the apparatus 100 of FIG. 4*a*. FIGS. 5*a*, 5*c*, 5*e* and 5*g* depict top views; and FIGS. 5*b*, 5*d*, 5*f* and 5*h* depict front views. FIGS. 5*i* and 5*j* depict end views.

Figure 6B:
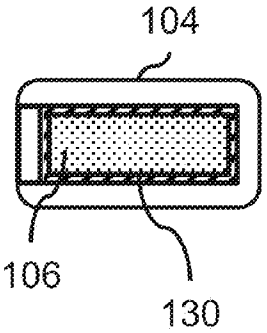
FIGS. 6*a* and 6*b* (SHEET 15 of 15 SHEETS) depict views of embodiments of an apparatus including a rigid thermally-insulated container, a table assembly, a lid assembly, a table-support assembly, and a collapsible thermally-insulated container.
Figure 6A:
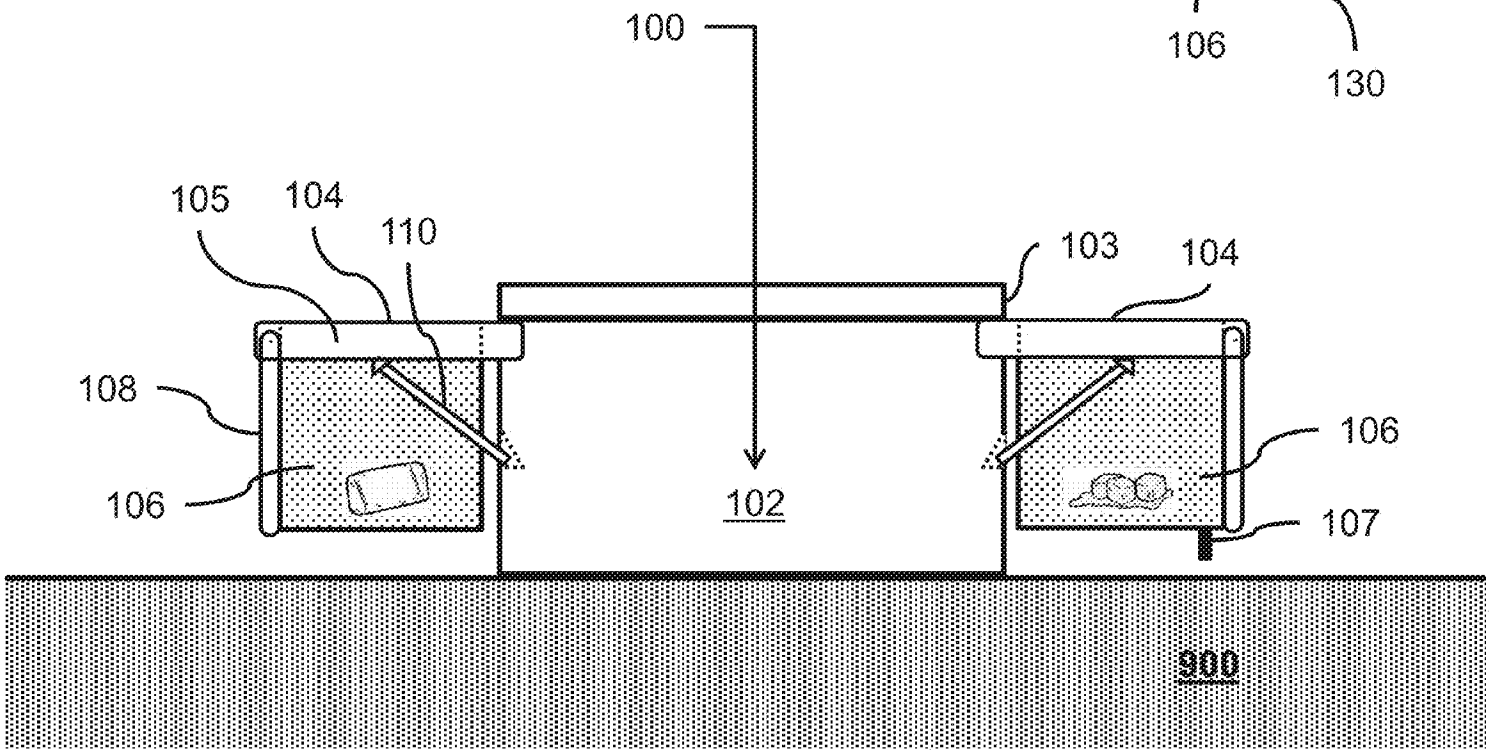

With reference to the embodiments of FIGS. 5*a* to 5*h*, the table assembly 104 includes a lid assembly 108 configured to interact with the table assembly 104 in such a way to facilitate user access to the collapsible thermally-insulated container 106 to be mounted to the table assembly 104 (FIG. 6*a* depicts the collapsible thermally-insulated container 106 operatively mounted to the table assembly 104).

With reference to the embodiments of FIGS. 5*a* to 5*h*, the table assembly 104 includes a table-support assembly 110 configured to provide support to the table assembly 104 (specifically, from below the table assembly 104). In this manner, the table assembly 104 maintains a stationary position relative to the rigid thermally-insulated container 102, and to a top surface of the rigid thermally-insulated container 102.

Referring to the embodiments of FIGS. 5*a* and 5*b*, an instance of the table assembly 104 is mounted to opposite sides of the rigid thermally-insulated container 102. The instances of the lid assembly 108 are fully received in a respective instance of the table assembly 104. The instances of the table-support assembly 110 are positioned underneath the instances of the table assembly 104. The table-support assembly 110 is configured to provide support to the table assembly 104 and the weight to be operatively held (received) by the table assembly 104. An instance of the table-support assembly 110 is positioned on opposite sides of the table assembly 104. It will be appreciated that the embodiments of FIGS. 5*a* and 5*b* correspond (at least in part) with the embodiment of FIG. 3*d*.

Referring to the embodiment of FIGS. 5*a* and 5*b*, the lid assembly 108 is folded up parallel to the ground 900, and is positioned to cover the entrance 105 of the table assembly 104 (the closed position). In the closed position, the lid assembly 108 forms or provides a smooth table top surface of the table assembly 104 (for use as a table surface for the user) once positioned in the closed position of FIGS. 5*a* and 5*b*.

Referring to the embodiment of FIG. 5*b*, the table-support assembly 110 is aligned at about a 45 degree angle relative to the horizontal alignment of the top of the table assembly 104 (once the table assembly 104 is attached to the rigid thermally-insulated container 102). For instance, one end of the table-support assembly 110 is snap-fitted into a base portion of the rigid thermally-insulated container 102 at a lower section of the side wall of the rigid thermally-insulated container 102. For instance, a T-type bracket may be mounted to the vertically-extending side wall of the rigid thermally-insulated container 102, and the T-type bracket is configured to provide support for (and receive weight from) the table-support assembly 110 (and the weight held by the table assembly 104). The table assembly 104 includes an interface device configured to interface with an opposite end of the table-support assembly 110.

Referring to the embodiment of FIG. 5*b*, the table assembly 104 is provided with table-support assembly 110 positioned on opposite sides of the table assembly 104. The table-support assembly 110 is configured to be fixedly attachable to (or may securely contact or engage) a selected side of the rigid thermally-insulated container 102. The table-support assembly 110 is configured to fixedly secure the table assembly 104 to the rigid thermally-insulated container 102. In this manner, the table-support assembly 110 is configured to support the weight of the table assembly 104 and the weight to be received by the table assembly 104. The table assembly 104 is fixedly positioned (connected) to the rigid thermally-insulated container 102; it will be appreciated that the top surface of the table assembly 104 may be oriented in-line with the rigid thermally-insulated container 102 (if so desired). In accordance with an option, the table-support assembly 110 contacts the ground, if so desired. For the case where the ground 900 is uneven, then the table-support assembly 110 is connected to the rigid thermally-insulated container 102.

Referring to the embodiments of FIGS. 5*c* and 5*d*, the lid assembly 108 is partially moved away from the table assembly 104 in order to partially reveal the entrance 105 defined by the table assembly 104. The embodiments of FIGS. 5*c* and 5*d* correspond with the embodiment of FIG. 3*e*. Each instance of the table assembly 104 has a respective instance of the lid assembly 108 configured to slidably engage the table assembly 104. Specifically, the lid assembly 108 is configured to slide horizontally away from the rigid thermally-insulated container 102 toward an outer edge of the table assembly 104 (in response to the user 910 pulling on the lid assembly 108).

Referring to the embodiments of FIGS. 5*e* and 5*f*, the lid assembly 108 is fully moved away (extended or horizontally extended) in order to fully reveal the entrance 105 defined by the table assembly 104. The lid assembly 108 is depicted in a horizontal alignment (relative to the ground or the working surface such the table top of a picnic table or the seat surface of the picnic table, etc.).

Referring to the embodiments of FIGS. 5*g* and 5*h*, the lid assembly 108 is permitted to vertically extend below the table assembly 104 (at one side thereof) while the entrance 105 remains fully revealed (to the user). The embodiments of FIGS. 5*g* and 5*h* correspond with the embodiment of FIG. 3*f*. Referring to the embodiments of FIGS. 5*g*, 5*h* and 3*g*, the lid assembly 108 is configured to fold down (to become vertically aligned) once the lid assembly 108 has been moved far enough from the rigid thermally-insulated container 102 (and the user releases the lid assembly 108).

Referring to the embodiments of FIGS. 5*g* and 5*h*, for the case where the user has a need to retrieve an item that is stored in (contained) in the collapsible thermally-insulated container 106 (depicted in FIG. 6*a*), the lid assembly 108 of the table assembly 104 is moved to the open position (as depicted in FIGS. 5*g* and 5*h*, in which the lid assembly 108 is hanging perpendicular to the ground). For the case where the user has a need to close the container lid 103 in the closed position (as depicted in FIGS. 5*a* and 5*b*), the lid assembly 108 is moved accordingly and remains operatively coupled to the table assembly 104; in the closed position, the items held in the collapsible thermally-insulated container 106 may remain cool until needed by the user.

Referring to the embodiment depicted in FIG. 5*i*, a single instance of the table-support assembly 110 is provided, and is positioned underneath the table assembly 104 at a location that is midway between the front side and the back side of the rigid thermally-insulated container 102.

Referring to the embodiment depicted in FIG. 5*j*, two instances of the table-support assembly 110 are provided, and are positioned underneath the table assembly 104 at locations that are on opposite sides of the rigid thermally-insulated container 102. One instance of the table-support assembly 110 is mounted proximate to the back side of the rigid thermally-insulated container 102, and another instance of the table-support assembly 110 is mounted proximate to the front side of the rigid thermally-insulated container 102.

FIGS. 6*a* and 6*b* depict views of embodiments of the apparatus 100 including the rigid thermally-insulated container 102, the table assembly 104, the lid assembly 108, the table-support assembly 110, and the collapsible thermally-insulated container 106. FIG. 6*a* depicts a front view. FIG. 6*b* depicts a top view.

Referring to the embodiment of FIG. 6*a*, there is depicted an apparatus 100. The apparatus 100 includes (and is not limited to) a combination of the rigid thermally-insulated container 102, the table assembly 104, and the collapsible thermally-insulated container 106. It will be appreciated that once the lid assembly 108 has been moved to the open position (as depicted in FIG. 6*a*), the entrance 105 is revealed to the user; in this manner, the interior of the collapsible thermally-insulated container 106 becomes exposed to the user (as depicted in FIG. 6*a*). The collapsible thermally-insulated container 106 is configured to be positioned inside the entrance 105 and the collapsible thermally-insulated container 106 is mounted to the table assembly 104. In this way, once the lid assembly 108 has been moved to one side of the entrance 105, the user may retrieve an item positioned in the collapsible thermally-insulated container 106 (when desired). For instance, the entrance 105 may be about 80% of the table top surface of the table assembly 104 (if so desired).

For instance, the collapsible thermally-insulated container 106 is configured to be selectively attachable to the table assembly 104. In accordance with the embodiment depicted FIG. 6*a*, instances of the collapsible thermally-insulated container 106 are each configured to be selectively attachable to a respective instance of the table assembly 104. In accordance with an option, the collapsible thermally-insulated container 106 is further configured to be selectively detachable from the table assembly 104. It will be appreciated that in a deployment position (as depicted in FIG. 6*a*), the collapsible thermally-insulated container 106 is fixedly attachable to the table assembly 104 in such a way that the collapsible thermally-insulated container 106 remains in an erect state (condition). It will be appreciated that in a storage position (as depicted in FIG. 4*a*), the collapsible thermally-insulated container 106 is fixedly detachable from the table assembly 104 in such a way that the collapsible thermally-insulated container 106 collapses into a collapsed state. Specifically, the collapsible thermally-insulated container 106 is fixedly attachable to the table assembly 104 in the deployment position (FIG. 6*a*). Specifically, the collapsible thermally-insulated container 106 is fixedly detachable from the table assembly 104 in the storage position (FIG. 4*a*). In the deployment position (as depicted in FIG. 6*a*), the rigid thermally-insulated container 102, the table assembly 104 and the collapsible thermally-insulated container 106 are positioned relative to each other in such way that cooling space is increased, at least in part, beyond the cooling space provided by the rigid thermally-insulated container 102. In the storage position (as depicted in FIG. 4*a*), the rigid thermally-insulated container 102, the table assembly 104 and the collapsible thermally-insulated container 106 are positioned relative to each other in such way that storage space required is the storage space required for storage of the rigid thermally-insulated container 102. In accordance with an option, the collapsible thermally-insulated container 106 includes a drain port 107 that is configured to permit flow of drainage from an interior of the rigid thermally-insulated container 102 positioned in the deployment position (as depicted in FIG. 6*a*).

In view of the foregoing, there is also provided a method of operating the apparatus 100. The method includes (and is not limited to): (A) an operation of selectively attaching the table assembly 104 to the rigid thermally-insulated container 102; and (B) an operation of selectively attaching the collapsible thermally-insulated container 106 to the table assembly 104. The method also includes additional operations, such as: (C) an operation of selectively detaching the collapsible thermally-insulated container 106 from the table assembly 104; and (D) an operation of selectively detaching the table assembly 104 from the rigid thermally-insulated container 102.

Referring to the embodiment depicted in FIG. 6*a*, the apparatus 100 is configured to reduce space required to store the rigid thermally-insulated container 102 in the trunk space of a car without sacrificing storage space or functionality of the rigid thermally-insulated container 102. The apparatus 100 is configured to increase (at least in part) the available cooler space of the rigid thermally-insulated container 102 while reducing (at least in part) the space required to transport the rigid thermally-insulated container 102, and thereby reduce (at least in part) cost of ownership of the rigid thermally-insulated container 102 and improving (at least in part) user convenience. In addition, the extra cooling space provided by the apparatus 100 (over and above that provided by the rigid thermally-insulated container 102) may facilitate convenient retrieval of additional (extra) stored items. For instance, the collapsible thermally-insulated container 106 is configured to receive cooling material (such as, ice, ice packs, cooling packs, etc.); in this manner, the user may place beverage containers (an item to be kept cool) into the collapsible thermally-insulated container 106. In this manner, the available cooler space of the rigid thermally-insulated container 102 may be increased (at least in part). In addition, the table assembly 104 provides (at least in part) additional table space that may be usable for meal preparation or receiving user items (beverage containers, food items, etc.). It will be appreciated that the table assembly 104 may also be called a support structure configured to support spatial stationary orientation of the collapsible thermally-insulated container 106 in a deployment position.

For instance, it will be appreciated that the apparatus 100 may provide an additional 60% to 80% more cooler space (in use) for the rigid thermally-insulated container 102 while allowing a smaller trunk space for transport of the apparatus 100. The apparatus 100 may allow users to keep beverages and food separate; for instance, a user may use the collapsible thermally-insulated container 106 for their specific beverages, etc., and use the rigid thermally-insulated container 102 for containing food items.

Referring to the embodiment of FIG. 6*a*, the collapsible thermally-insulated container 106 is configured to receive user items to be cooled (once placed in a deployed position as depicted in FIG. 6*a*); the collapsible thermally-insulated container 106 may, for instance, receive a bottle of wine or a bottle of champagne without the user having to retrieve these items from the rigid thermally-insulated container 102. Once received in the collapsible thermally-insulated container 106, the bottle may be positioned vertically and thus avoid horizontal alignment of the bottle in the rigid thermally-insulated container 102 (for instance).

Referring to the embodiment of FIG. 6*a*, the collapsible thermally-insulated container 106 may include a drain port 107 configured to release unwanted fluid (such as melted ice water) from the interior of the collapsible thermally-insulated container 106 to an exterior of the collapsible thermally-insulated container 106. As depicted in FIG. 6*a*, the collapsible thermally-insulated container 106 is configured to be positioned inside the entrance 105 and the collapsible thermally-insulated container 106 is mounted to the table assembly 104. The collapsible thermally-insulated container 106 may include (for instance) a tight mesh bag configured to support the weight of beverage containers, food items, etc., received in the collapsible thermally-insulated container 106. The collapsible thermally-insulated container 106 may be positioned as close to the table assembly 104 as possible, allowing for as much extra storage as possible in the collapsible thermally-insulated container 106 (if so desired).

It will be appreciated that (in accordance with an option): (A) the collapsible thermally-insulated container 106 has an outer surface configured to be selectively attachable to and detachable from an outer-facing side edge of the table assembly 104; (B) the table assembly 104 does not define the collapsible thermally-insulated container 106; and (C) the collapsible thermally-insulated container 106 has a lid operatively connected to the collapsible thermally-insulated container 106.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

It may be appreciated that the assemblies and modules described above may be connected with each other as may be required to perform desired functions and tasks that are within the scope of persons of skill in the art to make such combinations and permutations without having to describe each and every one of them in explicit terms. There is no particular assembly, or components, that are superior to any of the equivalents available to the art. There is no particular mode of practicing the disclosed subject matter that is superior to others, so long as the functions may be performed. It is believed that all the crucial aspects of the disclosed subject matter have been provided in this document. It is understood that the scope of the present invention is limited to the scope provided by the independent claim(s), and it is also understood that the scope of the present invention is not limited to: (i) the dependent claims, (ii) the detailed description of the non-limiting embodiments, (iii) the summary, (iv) the abstract, and/or (v) the description provided outside of this document (that is, outside of the instant application as filed, as prosecuted, and/or as granted). It is understood, for the purposes of this document, that the phrase "includes" is equivalent to the word "comprising." It is noted that the foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a rigid thermally-insulated container;

a table assembly being configured to be selectively attachable to the rigid thermally-insulated container; and a collapsible thermally-insulated container being configured to be selectively attachable to the table assembly; and the table assembly defining an entrance having an inner wall extending along an inner perimeter of the entrance; and a first touch fastener being positioned along, at least in part, the inner perimeter of the entrance defined by the table assembly; and the collapsible thermally-insulated container having an exterior periphery; and a second touch fastener being positioned on, at least in part, the exterior periphery of the collapsible thermally-insulated container in such a way that the collapsible thermally-insulated container is selectively connectable to the table assembly once the second touch fastener of the collapsible thermally-insulated container is securely connected to the first touch fastener of the table assembly; and the second touch fastener being positioned on, at least in part, the exterior periphery of the collapsible thermally-insulated container in such a way that the collapsible thermally-insulated container is selectively disconnectable from the table assembly once the second touch fastener of the collapsible thermally-insulated container is disconnected from the first touch fastener of the table assembly; and the first touch fastener and the second touch fastener being configured to support the weight of the collapsible thermally-insulated container, and to support the operative weight to be received by the collapsible thermally-insulated container once the collapsible thermally-insulated container is securely connected to the table assembly.

2. The apparatus of claim 1, wherein:

the table assembly is further configured to be selectively detachable from the rigid thermally-insulated container.

3. The apparatus of claim 1, wherein:

the collapsible thermally-insulated container is further configured to be selectively detachable from the table assembly.

4. The apparatus of claim 1, wherein:

the collapsible thermally-insulated container is fixedly attachable to the table assembly in such a way that the collapsible thermally-insulated container remains in an erect state.

5. The apparatus of claim 1, wherein:

the collapsible thermally-insulated container is detachable from the table assembly in such a way that the collapsible thermally-insulated container collapses into a collapsed state.

6. The apparatus of claim 1, wherein:

the collapsible thermally-insulated container is fixedly attachable to the table assembly in a deployment position.

7. The apparatus of claim 1, wherein:

the collapsible thermally-insulated container is detachable from the table assembly in a storage position.

8. The apparatus of claim 1, wherein:

the table assembly is fixedly attached to the rigid thermally-insulated container once positioned at a deployment position.

9. The apparatus of claim 1, wherein:

the table assembly is detached from the rigid thermally-insulated container once positioned at a storage position.

10. The apparatus of claim 1, wherein:

in a deployment position, the rigid thermally-insulated container, the table assembly and the collapsible thermally-insulated container are positioned relative to each other so that cooling space is increased, at least in part, beyond the cooling space provided by the rigid thermally-insulated container.

11. The apparatus of claim 1, wherein:

in a storage position, the rigid thermally-insulated container, the table assembly and the collapsible thermally-insulated container are positioned relative to each other so that storage space is for storage of the rigid thermally-insulated container.

12. The apparatus of claim 1, wherein:

the collapsible thermally-insulated container includes:

a drain port being configured to permit flow of drainage from an interior of the rigid thermally-insulated container positioned in a deployment position.

13. The apparatus of claim 1, wherein:

the table assembly defines the entrance configured to interface with the collapsible thermally-insulated container.

14. The apparatus of claim 1, wherein:

the table assembly includes:

a lid assembly configured to interact with the table assembly in such a way as to facilitate user access to the collapsible thermally-insulated container.

15. The apparatus of claim 1, wherein:

the table assembly includes:

a table-support assembly configured to provide support to the table assembly from below the table assembly.

16. The apparatus of claim 1, wherein:

a container interface extends from a bottom surface of the table assembly once the table assembly is positioned in a horizontal condition;

an outer perimeter of a container side wall of the rigid thermally-insulated container defines a recess zone that faces outwardly from the container side wall at a top section of the container side wall;

a table interface is positioned on a top portion of the container side wall below the recess zone, and the table interface is in communication with the recess zone; and the recess zone extends, at least in part, from a front wall to a back wall of the rigid thermally-insulated container.

17. The apparatus of claim 16, wherein:

the recess zone is configured to accommodate, at least in part, an edge portion of the table assembly, while the container interface of the table assembly is receivable in the table interface provided by the top section of the container side wall of the rigid thermally-insulated container.

18. The apparatus of claim 17, wherein:

the table interface and the container interface are aligned along a coaxial direction extending along a vertical direction once operatively installed relative to each other.

19. A method of operating an apparatus including a rigid thermally-insulated container, a table assembly, and a collapsible thermally-insulated container, the method comprising:

selectively attaching the table assembly to the rigid thermally-insulated container, and the table assembly defining an entrance having an inner wall extending along an inner perimeter of the entrance, and a first touch fastener being positioned along, at least in part, the inner perimeter of the entrance defined by the table assembly; and selectively attaching the collapsible thermally-insulated container to the table assembly, and the collapsible thermally-insulated container having an exterior periphery, and a second touch fastener being positioned on, at least in part, the exterior periphery of the collapsible thermally-insulated container; and selectively securely connecting the second touch fastener of the collapsible thermally-insulated container to the first touch fastener of the table assembly in such a way that the collapsible thermally-insulated container becomes selectively connected to the table assembly; and selectively disconnecting the second touch fastener of the collapsible thermally-insulated container from the first touch fastener of the table assembly in such a way that the collapsible thermally-insulated container becomes selectively disconnected from the table assembly; and using the first touch fastener and the second touch fastener to support the weight of the collapsible thermally-insulated container, and to support the operative weight to be received by the collapsible thermally-insulated container once the collapsible thermally-insulated container is securely connected to the table assembly.

20. The method of claim 19, further comprising:

selectively detaching the collapsible thermally-insulated container from the table assembly; and selectively detaching the table assembly from the rigid thermally-insulated container.

* * * * *